US006280581B1

(12) United States Patent
Cheng

(10) Patent No.: US 6,280,581 B1
(45) Date of Patent: Aug. 28, 2001

(54) METHOD AND APPARATUS FOR ELECTROPLATING FILMS ON SEMICONDUCTOR WAFERS

(76) Inventor: David Cheng, 711 Hibernia Ct., Sunnyvale, CA (US) 94086

( * ) Notice: Subject to any disclaimer, the term of this patent is extended or adjusted under 35 U.S.C. 154(b) by 0 days.

(21) Appl. No.: 09/222,545

(22) Filed: Dec. 29, 1998

(51) Int. Cl.[7] ..... C25D 17/00
(52) U.S. Cl. ..... 204/224 R
(58) Field of Search ..... 204/224 R, 297 R, 204/212, 279, 280, 286.1; 205/133

(56) References Cited

U.S. PATENT DOCUMENTS

| | | | | |
|---|---|---|---|---|
| 4,687,562 | * | 8/1987 | Smith et al. | 204/206 |
| 5,421,987 | * | 6/1995 | Tzanavaras et al. | 205/133 |
| 5,447,615 | * | 9/1995 | Ishida | 204/224 R |
| 5,522,975 | * | 6/1996 | Andricacos et al. | 204/297 R |
| 5,670,034 | * | 9/1997 | Lowery | 205/143 |
| 6,001,235 | * | 12/1999 | Arken et al. | 204/212 |
| 6,004,440 | * | 12/1999 | Hanson et al. | 204/279 |
| 6,042,712 | * | 3/2000 | Mathieu | 205/209 |
| 6,103,096 | * | 8/2000 | Datta et al. | 205/686 |

* cited by examiner

*Primary Examiner*—Kathryn Gorgos
*Assistant Examiner*—Erica Smith-Hicks
(74) *Attorney, Agent, or Firm*—Oppenheimer Wolff & Donnelly, LLP

(57) ABSTRACT

An electroplating apparatus includes a cathode structure, an anode structure, a power supply, and a pressurized electrolyte source. The cathode structure is configured to engage a perimeter portion of a workpiece such as a semiconductor wafer, and the anode structure includes an outlet. The power supply is coupled between the cathode structure and the anode structure. The pressurized electrolyte source is coupled to the anode structure to provide an electrically continuous fluid jet of an electrolyte from the outlet to be directed to a surface of the workpiece that is to be electroplated. A method for electroplating a workpiece includes electrically engaging a perimeter portion of the workpiece with a cathode structure, and directing an electrically continuous fluid jet of electrolyte having positively charged ions towards a surface of the workpiece that is to be electroplated. Preferably, there is a mechanism for providing relative motion between the workpiece and the jet of electrolytes, such as a mechanism for moving the electrically continuous fluid jet of electrolyte to a number of radial positions as the workpiece is rotated around an axis of rotation.

21 Claims, 13 Drawing Sheets

METHOD AND APPARATUS FOR ELECTROPLATING FILMS ON SEMICONDUCTOR WAFERS

BACKGROUND OF THE INVENTION

This invention relates generally to electroplating methods and apparatus, and more particularly to methods and apparatus for electroplating copper films on semiconductor wafers.

Electroplating is a very old art, dating back to the $19^{th}$ century. A simple electroplating apparatus includes a container for an electrolyte and an anode and a cathode immersed in the electrolyte. The power source, e.g. a battery or a power supply, is coupled to the anode and the cathode to cause current to flow through the electrolyte. Part of this current flow is positively charged metal ions which are attracted to and adhere to the cathode or to any conductive material coupled to the cathode. A metal film is therefore developed on a conductive object coupled to the cathode due to the electroplating process.

As noted, electroplating has been used for many years and for a variety of purposes. For example, precious metals such as silver or gold are often electroplated onto less expensive base materials to make jewelry. Electroplating has also been used to develop metal films on semiconductor wafer substrates for a variety of purposes. There is currently a great interest in the production of copper layers or "films" on semiconductor substrates which can be subsequently patterned into high speed interconnect lines.

There are many advantages in using copper (Cu) films for the next generations of semiconductor devices. Currently, aluminum (Al) and aluminum-copper (Al—Cu) alloys are the materials most commonly used to provide electrical connections between devices of an integrated circuit. However, aluminum and aluminum-copper alloys have a relatively high resistivity (compared to copper) which impede high-speed operation of the integrated circuit. That is, as integrated circuits are operated at higher and higher frequencies, the resistivity of the interconnect lines becomes a limiting factor. Copper has a lower resistivity than aluminum or aluminum-copper alloys and, therefore, is becoming increasingly of interest for its use as high-speed interconnect lines.

At the present time, copper is being deposited on semiconductor substrates by three primary processes. These processes are Physical Vapor deposition (PVD), Chemical Vapor Deposition (CVD) and electroplating. As will be noted subsequently, each of these conventional methods has its advantages and disadvantages.

Physical Vapor Deposition is accomplished within large, expensive machines produced by a number of vendors including Applied Materials, Inc., Novellus, Inc., and others. Within these machines, a plasma is developed which creates positively charged ions that are caused to collide with a copper target to produce a shower of copper particles on the surface of a wafer. PVD machines are very expensive, often costing many millions of dollars. In addition, the cost of operation of PVD machines is quite high. While the copper film properties and uniformity of film thickness are typically fairly good with PVD processes, their gap fill and uniformity of gap fill properties are very poor. By "gap fill" it is meant the ability of the process to fill the small gaps between features on the surface on the semiconductor wafer.

Chemical Vapor Deposition apparatus, also made by such companies as Applied Materials, Inc. and Novellus, Inc. are also very expensive machines. In addition, the cost of operating a CVD machine is typically even higher than that of operating a PVD machine. While the film properties produced by the CVD machine are only average as compared to those produced by a PVD machine, the uniformity of film thickness, gap fill, and uniformity of gap fill for a CVD machine are quite good.

The cost of electroplating equipment is quite low compared to that of PVD and CVD equipment. In addition, the cost of operation of electroplating equipment is relatively low. The properties of the films produced by electroplating tends to be quite good, and its gap fill properties are better than that those produced by either PVD or CVD processes. The uniformity of gap fill with electroplating techniques is also the best as compared with PVD and CVD processes. However, a major problem with electroplating techniques of the prior art is a lack of uniformity of the resultant film thickness, as compared to a much better uniformity of film thickness that can be achieved with the PVD or CVD processes.

Since copper has superior diffusion capability through certain other materials and layers of an integrated circuit, and can poison such other materials and layers, a barrier layer is provided over the semiconductor wafer surface prior to the deposition of a copper layer. The barrier layer is universally provided whether a PVD, CVD or electroplating technique is used to produce the copper layer (film). A typical material used for the barrier layer is Tantalum (Ta) although other materials such as Tungsten Nitride (WN), Titanium Nitride (TiN), Tantalum Nitride (TaN), and Tungsten (W) can also be used in the barrier layer.

In addition to a barrier layer, electroplating techniques of the prior art requires a seed layer of copper (a thin starter layer) to be provided over the barrier layer prior to the commencement of the copper electroplating process. This is because the electroplating technique is an electrochemical process which requires a continuous conductive path between an anode and an electrode. As will be discussed in greater detail below, this seed layer requirement of prior art electroplating techniques requires a relatively thick layer of copper film of, for example, 1,000 angstroms in order to provide an even marginally acceptable uniformity of film thickness. This seed layer can be provided by a PVD or CVD process, although this will substantially reduce the quality of the gap fill and the uniformity of the gap fill in the final film.

In FIG. 1, a conventional copper electroplating apparatus 10 includes a container 12 containing an electrolyte 14, such as copper sulfate ($CuSO_4$). An anode 16 is immersed within the electrolyte 14, and a cathode is partially immersed within the electrolyte. The cathode 18 is connected to the negative (−) terminal of a power supply 20, and the anode 16 is coupled to the positive (+) terminal of the power supply 20. While the power supply 20 is illustrated, in this example, as a battery, it will be appreciated to those skilled in the art that the power supply is more typically a voltage regulated AC-to-DC power supply.

A semiconductor wafer 22 is supported by a bottom surface 24 of the cathode 18. A number of contacts 26 make an electrical connection between the cathode 18 and the seed layer 28 formed on the active surface of the wafer 22.

In FIG. 2, a view taken along line 2—2 of FIG. 1 illustrates three contacts 26. The contacts and the rest of the chuck are insulated from the electrolyte such that only the wafer is exposed to the electrolyte. That is, the chuck and the contacts are preferably constructed primarily from an organic non-conductive material (e.g. a plastic) such as polypropylene or Teflon. The number and positioning of these contacts 26 are for the purpose of example, and it should be noted that fewer or more contacts can be used and that the contacts may be distributed around the perimeter of the wafer. However, the contacts 26 are preferably positioned at the perimeter of the wafer to reduce the amount of unusable area of the wafer. This perimeter position of the contacts results in a radially variable IR drop in the seed layer 28. That is, at the perimeter of the wafer the voltage V is high, and current I is high as indicated by the arrow 30, while in the central areas of the wafer the voltage V is low and the current I is low as indicated by the arrow 32. For this reason, the uniformity of the thickness of the electroplated film is difficult to control and in general quite poor.

The operation of a prior art copper electroplating apparatus 10 will be discussed with reference to both FIGS. 1 and 2. Positively charged copper ions ($Cu^+$) will be attracted to the cathode 18 and will be repelled by the anode 16 due to their relative negative and positive charges. These copper ions will electrochemically plate onto the seed layer 28 of the wafer 22. It will be appreciated that the copper ions in the electrolyte form a part of the electrical circuit as charge carriers which allows the current to flow between the positive and negative terminals of the power supply 20.

With the foregoing discussion, it is clear why the uniformity of the film thickness for prior electroplating techniques tends to be poor. Since the voltage and current near the perimeter of the wafer tends to be substantially higher than the voltage and current near the central portions of the wafer, copper plates onto the surface of the wafer 22 much more rapidly towards the edges of the wafer. This phenomenon can be reduced providing a thicker seed layer 28. However, as noted previously, the thicker seed layer results in poorer gap fill and uniformity of gap fill. In consequence, it has heretobefore been difficult to electroplate copper films on semiconductor wafers with both good uniformity of thickness and good gap fill properties.

SUMMARY OF THE INVENTION

The present invention provides a method and apparatus for electroplating copper on a semiconductor wafer with an improved uniformity of film thickness and with good gap fill properties. This is accomplished with a jet stream electroplating coating technique which provides a single charge carrier path to the wafer to provide better uniformity, control and versatility.

More particularly, an electroplating apparatus of the present invention includes a cathode structure configured to engage a perimeter portion of a workpiece, an anode structure including an outlet, a power source coupled between the cathode structure and the anode structure, and a pressurized electrolyte source coupled to the anode structure to provide an electrically continuous fluid jet of electrolyte from the outlet to be directed at the surface of the workpiece that is to be electroplated. Preferably, the cathode structure forms a part of an electrode assembly which further includes a seal to inhibit electrolyte from contacting the cathode structure. Even more preferably, this seal includes a source of pressurized purge gas coupled to the electrode assembly. The outlet of the anode structure is preferably provided by a jet nozzle supported near the end of an elongated arm. The arm, the nozzle or an anode disposed within the fluid path is electrically conductive and is coupled to the power source to serve as the anode. The arm is adapted to move such that the outlet can be positioned under different radial positions of the wafer as the wafer is rotated.

A method for electroplating a workpiece includes electrically engaging a perimeter portion of the workpiece with a cathode structure and directing an electrically continuous fluid jet of electrolyte having positively charged ions towards the surface of the workpiece to be electroplated. Preferably the workpiece is rotated around an axis of rotation as the fluid of the electrolyte is directed towards its surface. The electrically continuous fluid jet of electrolyte can be moved to a number of radial positions with respect to the axis of rotation of the workpiece. In addition to the foregoing method for providing relative motion, other methods can be used to provide a relative motion between the workpiece and the jet of electrolyte.

The opening of the anode can also be used to deliver cleaning solutions to the surface of the wafer, such as deionized (DI) water. This permits integrated cleaning with the deposition process, eliminating the need for an additional cleaning chamber.

The present invention provides many advantages over electroplating methods and apparatus of the prior art. For one, the seed layer can be made very thin, e.g. 100 Angstroms as compared with 1000 Angstroms required by prior art electroplating processes. In, some instances, the seed layer can be eliminated entirely by relying upon the conductivity of the barrier layer. The localized plating provided by the jet stream coating virtually eliminates the IR drop across surface wafer, providing better uniformity and better gap fill. The multiple processing steps of the present invention are integrated into a single apparatus and as stated previously, can include integrated cleaning. Further, the process and apparatus of the present invention is wafer size independent, allowing the easy migration to 300 mm or larger wafers. The hardware is relatively uncomplicated providing low cost and high reliability. Further, there are few adjustable parameters, thereby providing a stable process with wide process windows. Furthermore, the apparatus of the present invention requires fewer perimeter contacts than the prior art, reducing the unusable area of the wafer occupied by the contacts.

These and other advantages of the present invention will become apparent to those skilled in the art upon a reading of the following description of the invention and a study of the several figures of the drawing.

DETAILED DESCRIPTION OF THE PREFERRED EMBODIMENTS

Figure 1:
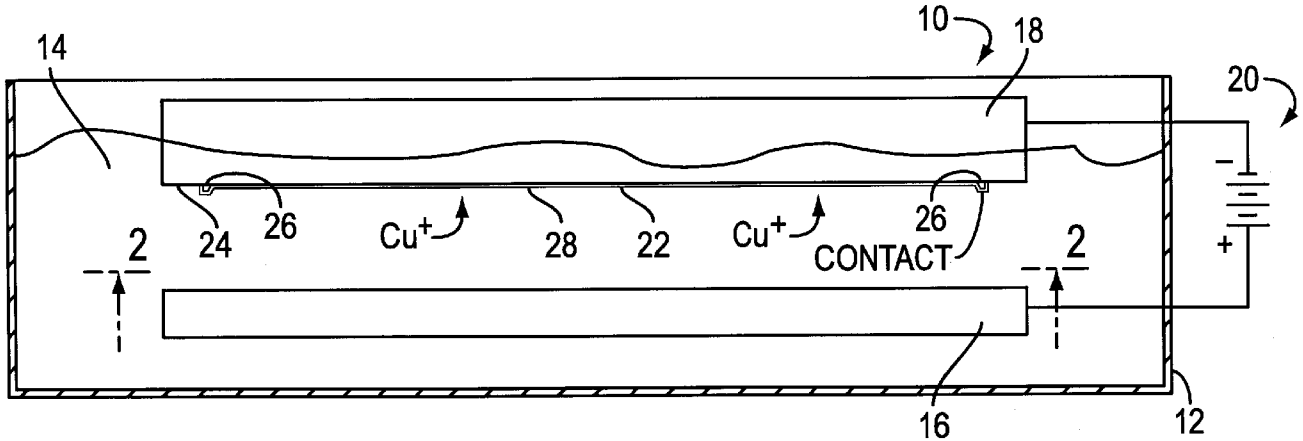
FIG. 1 (PRIOR ART)
FIG. 1 is a cross-sectional view of conventional copper electroplating apparatus.
Figure 2:
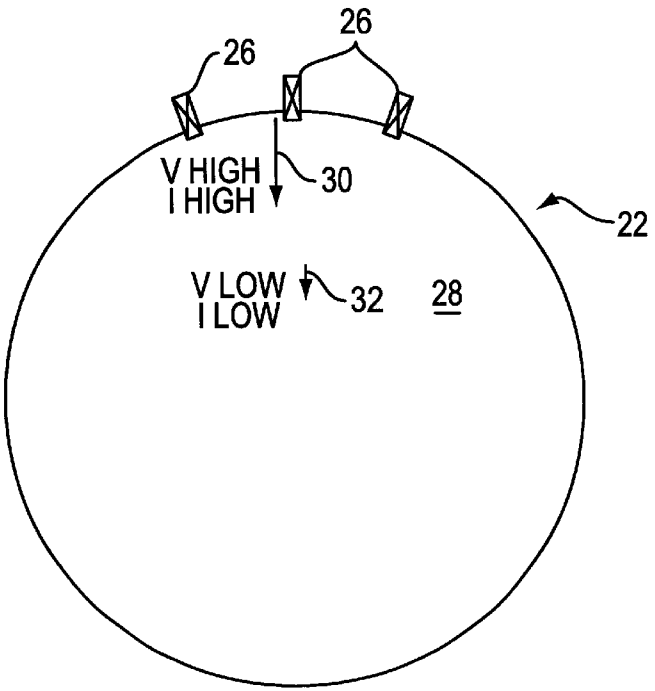
FIG. 2 (PRIOR ART)
FIG. 2 is a view taken along line 2—2 of FIG. 1.
Figure 3:
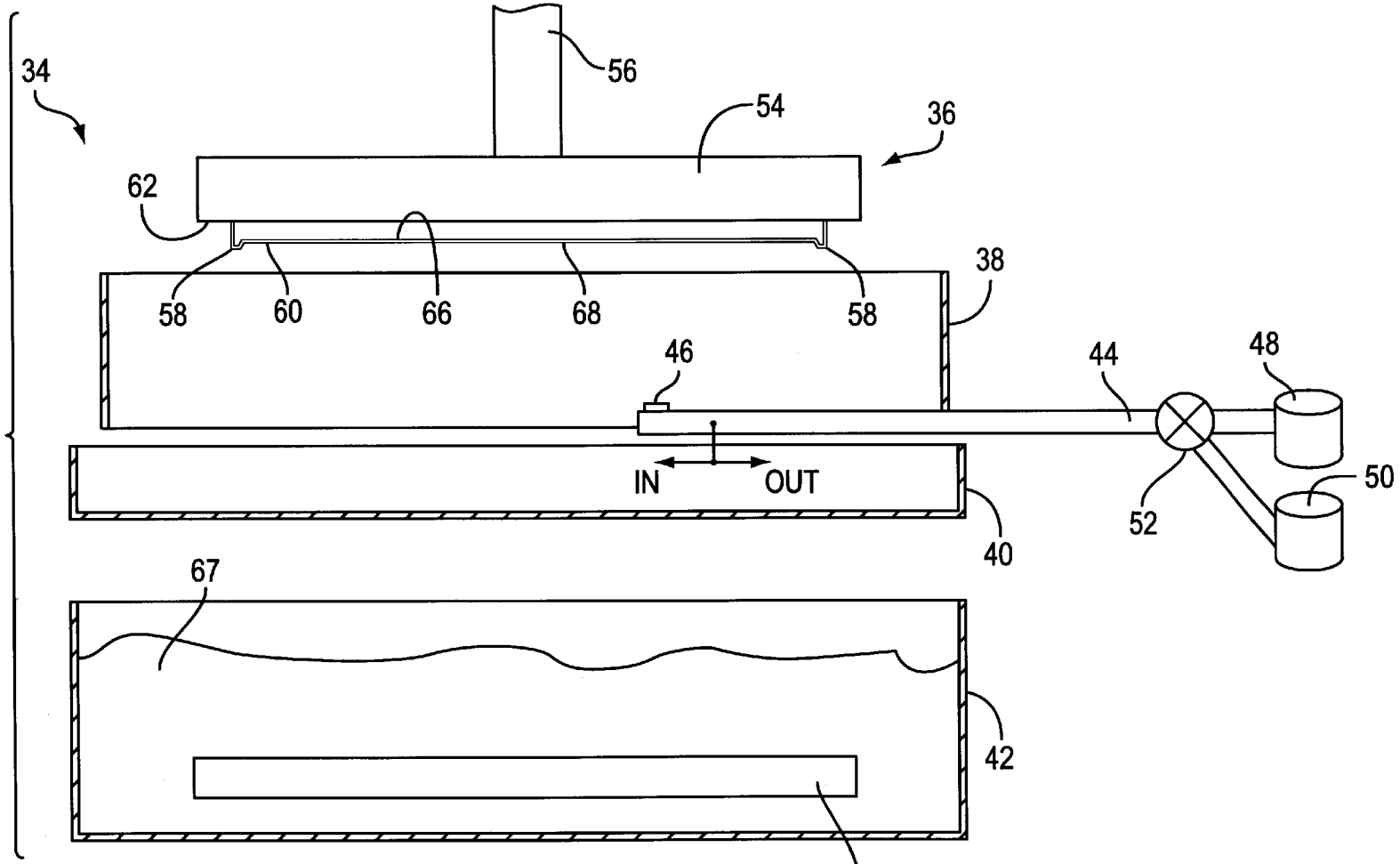
FIG. 3 is a cross-sectional view illustrating an electroplating apparatus of the present invention with the cathode wafer chuck in a wafer loading position.

FIGS. 1 and 2 were described with reference to the prior art. In FIG. 3, an electroplating apparatus 34 in accordance with the present invention includes a wafer chuck 36 which serves as a cathode, a splash shield 38, a collection tray 40, and a bulk deposition tub 42. Apparatus 34 further includes an anode structure 44 having an outlet 46. Anode structure 44 is preferably coupled to one or more pressurized fluid sources 48, 50, etc. by a valve mechanism 52.

It should be noted that a single anode structure ("arm") 44 with a single outlet is only one embodiment of an arm structure of the present invention. Multiple arms can be used simultaneously or sequentially, and multiple outlets can be provided in a single arm. Further, other structures than arms can be used to direct electrolyte against the surface of the wafer, as will be appreciated by those skilled in the art.

The cathode structure 36 includes a chuck 54 which is supported by a shaft 56. The shaft 56 may be rotated and moved up and down in a vertical direction as suggested by the arrows. The disk-shaped chuck 54 is preferably rigidly attached to the shaft 56 such that it moves up and down and rotates with the shaft. The cathode structure further includes a plurality of contacts 58 which serves to make an electrical connection between a perimeter portion of a wafer 60 and the chuck 54. The electrode assembly 58 can be moved up and down relative to the bottom surface 62 of the chuck 54 to permit the loading and unloading of the wafer 60.

The splash shield 38 is a hollow-cylindrical structure designed to prevent the splashing of electrolyte from the apparatus 34. The collection tray 40 collects electrolyte for disposal for recycling, as will be appreciated by those skilled in the art. The collection tray 40 is preferably provided with a drain (not shown) to effectuate the removal and possible collection, reconditioning, and recirculation of the ejected electrolyte.

In bulk deposition tub 42 is conventional in nature and is, like the splash shield 38 and collection tray 40, preferably cylindrical in shape. A bulk deposition anode 64 is immersed in electrolyte solution 67, such as the aforementioned $CuSO_4$ electrolyte solution. The anode 64 can be made from a variety of materials such as copper or platinum. If the anode is copper, it will diffuse into the electrolyte during the plating process, and the electrolyte should be removed and replenished on a periodic or continual basis. If the anode is platinum, it is essentially inert to the process and is not consumed by the process to any appreciable extent.

In FIG. 3, the cathode structure 36 is shown in its raised or "wafer loading" position. That is, the chuck 54 is raised above the splash shield 38, and the electrode assemblies 58 are lowered. As will be appreciated by those skilled in the art, when the cathode structure is in its raised position, a wafer 60 can be loaded and unloaded to the chuck 54 using, for example, a vacuum pick, which may be robotically controlled. More particularly the vacuum pick holds the wafer 60 by its backside 66 so as not to contact the front or active side 68. The pick then places the wafer 60 on the lowered electrode assemblies 58, at which time the pick releases the wafer by turning off the vacuum and retracting from the cathode structure 36. The electrode assemblies 58 are then retracted, pulling the back surface 66 of the wafer 60 against the bottom surface 62 of the chuck 54. As will be discussed in greater detail subsequently, a vacuum is then applied to the chuck 54 to firmly hold the wafer 60 against the chuck.

A wafer 60 is removed from the cathode structure 36 by reversing the aforementioned process. That is, the cathode structure 36 is raised to its load/unload position, the vacuum on the chuck 54 is released, the electrode assemblies 58 are lowered, a vacuum pick is inserted between the bottom surface 62 of chuck 54 and the back surface 66 of wafer 60, and the pick is withdrawn from the cathode structure to remove the wafer 68.

Figure 4:
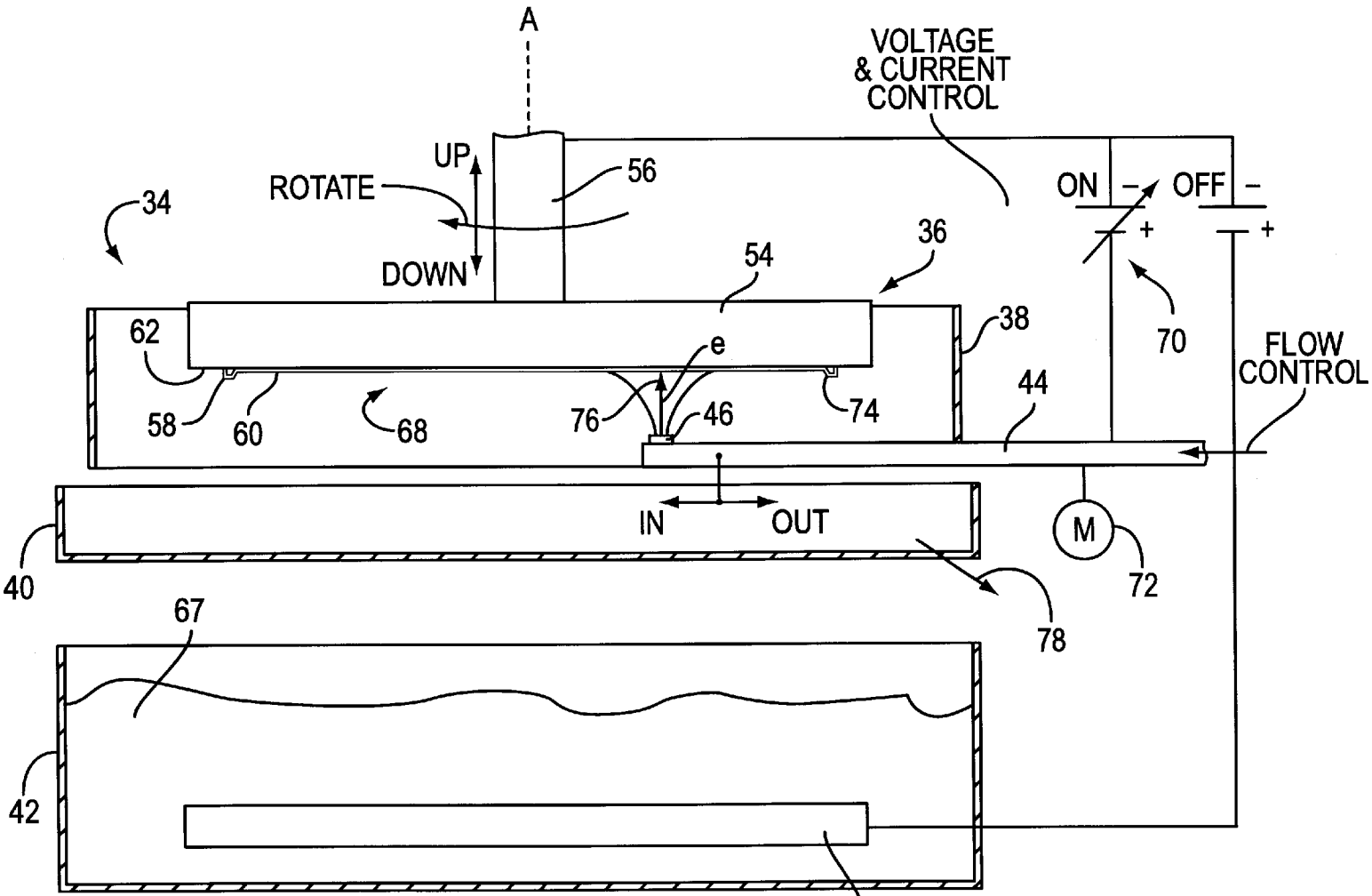
FIG. 4 illustrates the electroplating apparatus of the present invention during a jet stream coating process of the present invention.

In FIG. 4, an operational mode of the electroplating apparatus 34 is illustrated. The cathode structure 36 is lowered such that the lower surface 62 of the chuck 54 is within the volume of space surrounded by the splash shield 38. The anode structure, which is preferably an elongated hollow arm or tube, receives fluid from a pressurized electrolyte source (such as source 48 of FIG. 3) through a flow control mechanism, such as a valve 52. Preferably the flow control is under computerized control, as will be appreciated by those skilled in the art. A power supply 70 has its negative terminal coupled to the cathode structure 36 and has its positive terminal coupled to the anode structure 44. As noted, the power supply 70 is variable, and is also preferably under computer control. The anode structure 44 can move in and out as suggested by the arrows such that it can obtain multiple radial positions with respect to the wafer 60. This movement is controlled by a servo 72 such as stepper motor, solenoid, etc. The servo 72 is also preferably under computer control.

In operation, the power supply 70 is turned on, and the shaft 56 and therefore chuck 54 are caused to rotate. The anode structure is caused to be positioned near a peripheral edge 74 of the wafer 60 such that a jet stream 76 extends between the outlet 46 of the anode structure 44 and the front side 68 of the wafer 60.

The jet stream 76 is preferably not a spray of liquid but, rather, is a continuous stream of liquid which permits an electrical path "e" between the anode structure 44 and the cathode structure 36. That is, positive ions of copper flow as charge carriers within the continuous liquid jet stream 76 from the anode structure to the cathode structure. The jet stream 76 therefore forms an electrical connection between the anode structure 44 and the cathode structure 36 which allows the electroplating of copper on the front side 68 of the wafer 60.

It is necessary for the operation of the present invention that the flow of electrolyte allow a current to flow between the anode and the cathode. By "flow" it is meant the preferred continuous jet of electrolyte, a mixture of continuous jet of electrolyte with a spray of electrolyte (i.e. individual droplets) and, under some circumstances, just a spray of electrolyte. A pure spray of electrolyte limits the current flow, since the droplets do not typically carry large charges.

It is necessary for the electrode assemblies 58 to be electrically coupled to the negative terminal of the power supply 70. In this exemplary embodiment, the coupling takes place through the chuck 54 and the shaft 56. Therefore, in this embodiment, the chuck 54 and the shaft 56 are made from an electrically conductive material such as aluminum or copper. Likewise the anode structure 44 can be made of a conductive material, such as copper or platinum, although it will be appreciated by those skilled in the art that only a portion of the anode structure 44 along the flow path of the electrolyte needs to be electrically conductive. For example, the arm of the anode structure 44 can be made from insulating material, and the outlet or nozzle 46 can be made from, for example, copper or platinum that is electrically coupled to the positive terminal of the power supply 70. Alternatively, the arm and nozzle can be made electrically insulated material, and an electrode can be placed within the anode structure 44 to be connected to the positive terminal of the power supply 70. Preferably the electrode portion, whether it be the arm, the nozzle, a separate electrode, all three, or any combination thereof, etc. should be positioned as close as possible to the outlet 46 to minimize the IR drop within the electrolyte solution. It will therefore be appreciated that a wide variety of equivalents are available for the anode structure 44, as long as they provide positively charged copper ions for deposition on the wafer 60.

As a copper film forms in an annulus near the perimeter of the wafer, the anode structure 44 is caused to move toward the center of the wafer 60 to cause the annulus to widen in an inward direction. When the jet 46 reaches the center of the wafer 60, a continuous, uniform copper layer or film is formed on the active surface 68. Spilled electrolyte solution from the jet stream 78 is collected by collection tray 40 and is disposed of or recycled by flow control 78 as suggested by the arrow.

It will therefore be appreciated that this localized "plating" by a method of jet stream coating virtually eliminates the IR drop problem across the active surface 68 of the wafer as experienced in the prior art. This provides much better uniformity of film thickness and better gap fill than was possible with electroplating techniques of the prior art. Furthermore, the process and apparatus of the present invention are wafer size independent. That is, the process and apparatus can be scaled up or down to virtually any wafer size, making it very easy to migrate to 300 mm or larger wafers. The single current path provided by the jet stream 76 makes it easier to control the voltage and current to the apparatus, allowing feedback techniques to provide even better uniformity and process control, as will be appreciated by those skilled in the art.

Figure 5:
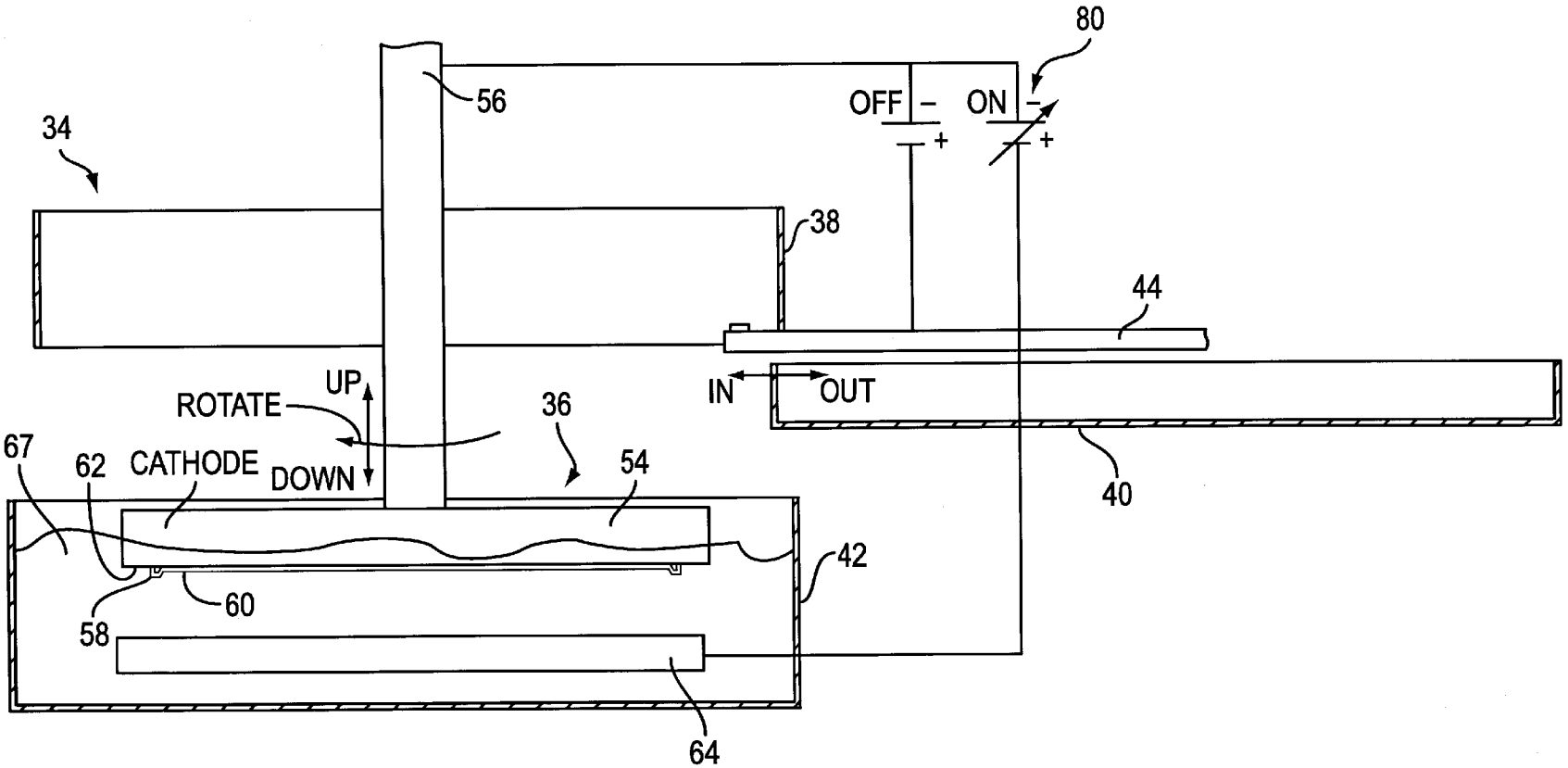
FIG. 5 illustrates a bulk deposition process of the present invention.

In FIG. 5, a bulk deposition process of the electroplating apparatus 34 of the present invention is illustrated. It should be noted that the process as described in FIG. 4 can be used to provide electroplated films of virtually any thickness. However, the process shown and described in FIG. 4, while providing superior film thickness and gap filling, is relatively slow compared to a bulk deposition process. Therefore, the process illustrated with respect to FIG. 4 can be used to provide a thick, electroplated copper film, e.g. 1,000 angstroms or more, as a "seed layer" for a bulk deposition process. The advantage of using the process of the present invention to create a thick seed layer is that it has the aforementioned better gap fill and uniformity of gap fill properties as compared to PVD and CVD methods for creating seed layers.

A bulk deposition process of the present invention is accomplished by retracting the anode structure 44 and the collection tray 40 as illustrated. The cathode structure 36 is then lowered by lowering shaft 56 until the lower surface 62 of chuck 54 is immersed within the electrolyte solution 67. Preferably the electrolyte solution is again $CuSO_4$. Such electrolyte is commercially available from a variety of sources including as Enthone-OMI, Inc. and Shipley, Inc. The bulk deposition process then proceeds as was described previously with respect to FIG. 1 until the copper layer is of the desired thickness.

Figure 6:
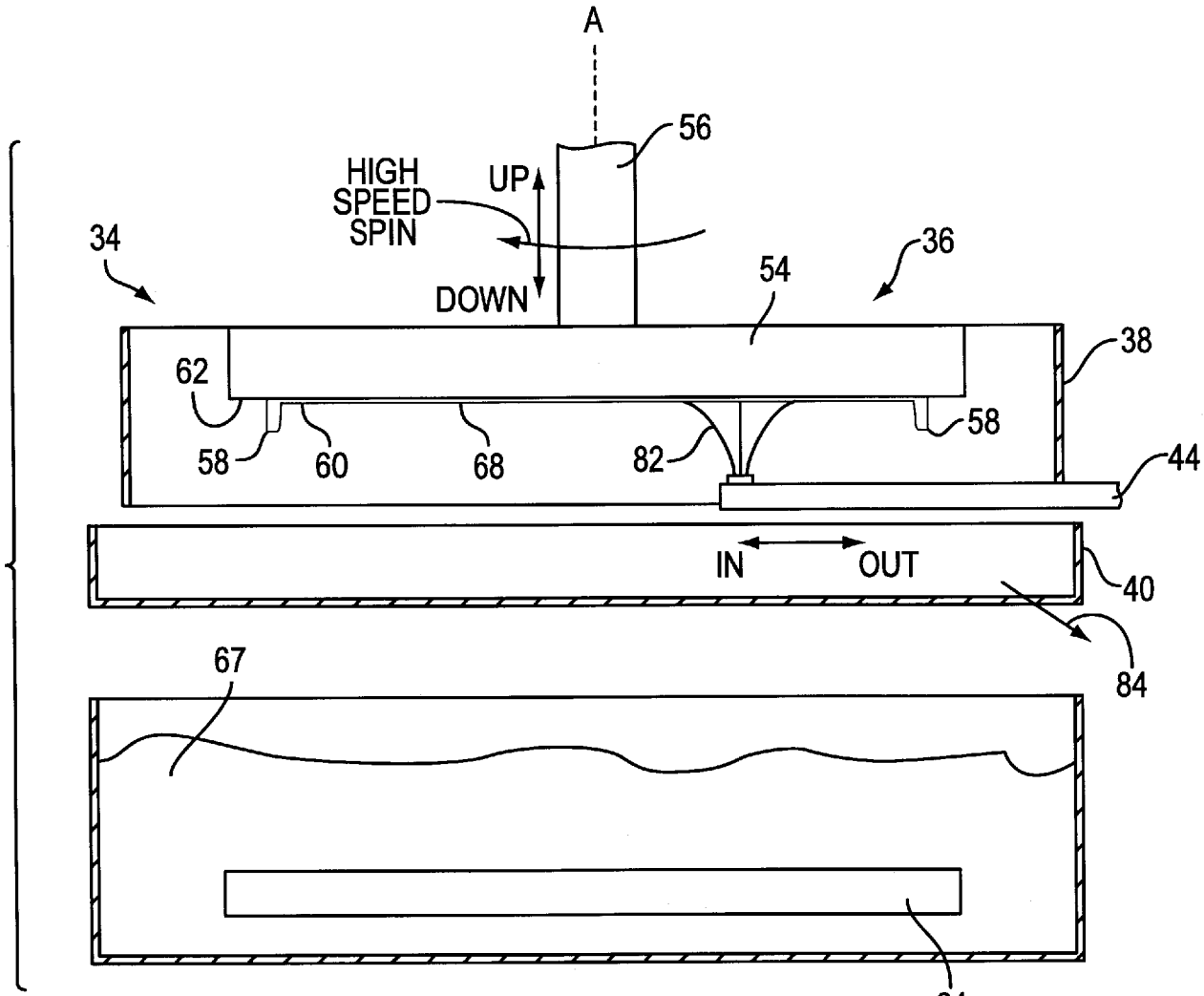
FIG. 6 illustrates a clean and drying process of the present invention.

In FIG. 6, an integrated cleaning of the cathode structure 36 is illustrated. In this instance, a stream of cleaning fluid, such as deionized (DI) water (such as from a source 50 in FIG. 3) creates a jet stream or spray 82 directed at the active surface 68 of the wafer 60. It is should be noted that during this cleaning process the electrode assemblies 58 are preferably extended such that the cleaning solution can clean the wafer, the electrode assemblies, and under the electrode assemblies. A vacuum provided by the vacuum chuck 54 holds the wafer 60 to the bottom surface 62 of the chuck during this cleaning operation.

More particularly, the electrode assembly 58 is extended from the active surface 68 of the wafer 60, and the shaft 56 and, in consequence, the chuck 54 and wafer 60 are caused to rotate around an axis A. The anode structure 44, now providing a stream of cleaning fluid 82, is caused to move in and out with respect to the center of the wafer 60 to provide a jet stream and/or spray of cleaning solution against the active surface 68 of the wafer 60. The cleaning solution is collected within the collection tray 40 and is disposed of as suggested by arrow 84. After the wafer has been cleaned, the jet stream 82 of cleaning solution can be stopped and the wafer can continue to rotate (preferably at high speed) to provide a spin drying effect. The wafer can then be removed from the cathode structure 36 as described previously, or may be subjected to additional electroplating processes.

Figure 7:
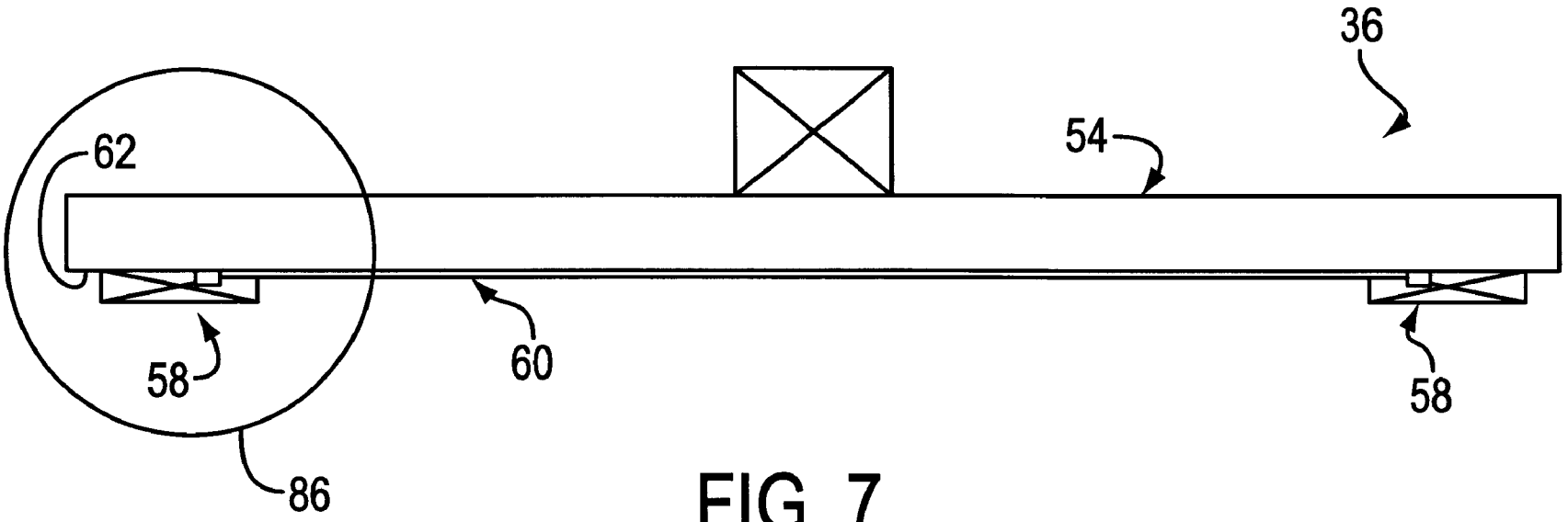
FIG. 7 illustrates in greater detail the wafer chuck of the present invention.

In FIG. 7, the chuck 54 of the cathode structure 36 is shown to include the electrode assemblies 58 which can serve the dual purposes of helping hold the wafer 60 to the bottom surface 62 of the chuck 54 and to provide electrical contact electrodes for the wafer 60. Detail views taken along area 86 will be discussed with reference to FIGS. 7A–7D.

Figure 7A:
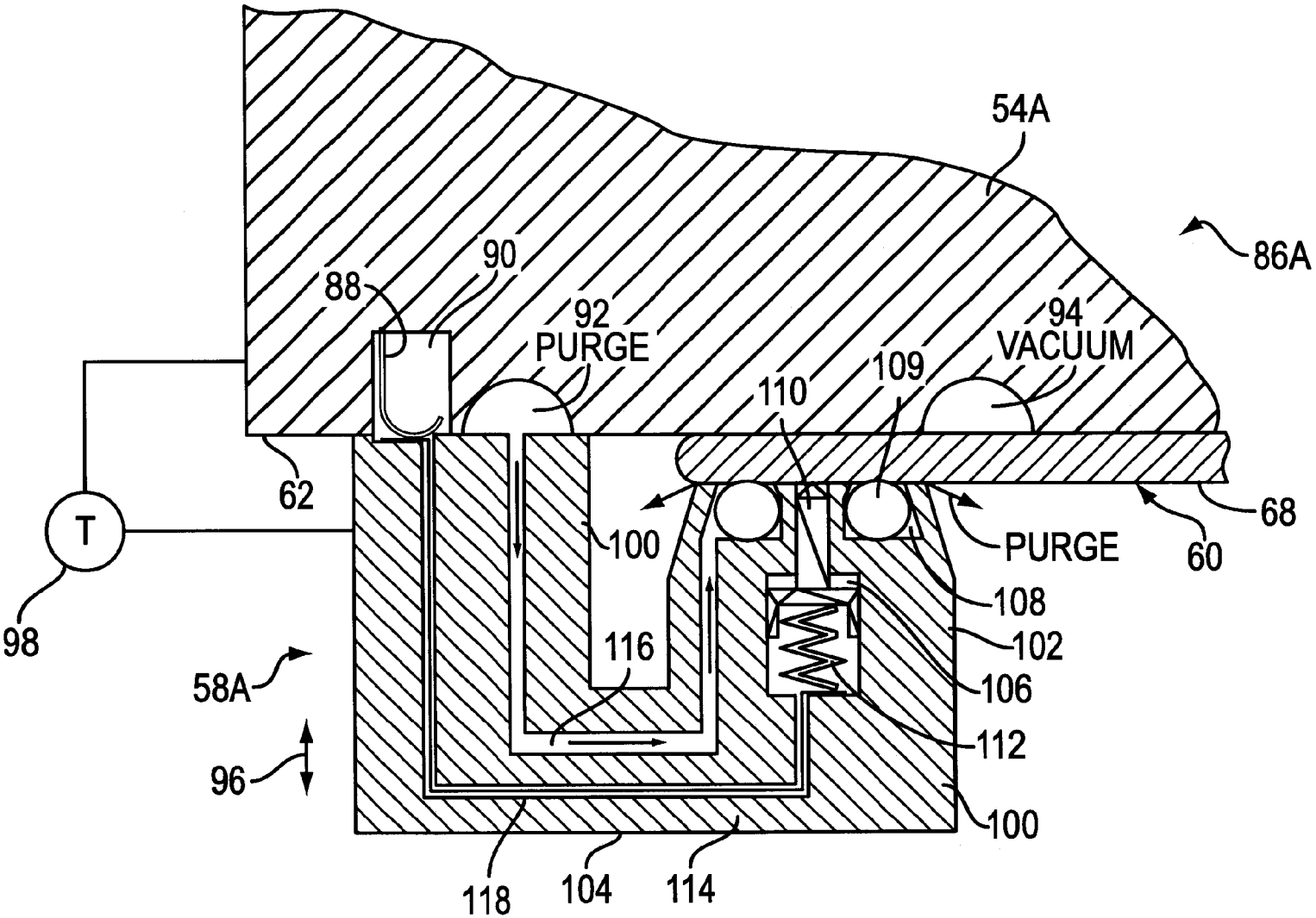
FIGS. 7A–7D illustrates four embodiments of an electrode assembly in accordance with the present invention.

In FIG. 7A, a vacuum chuck **58*a* includes an electrical contact 88 within an aperture 90, a purge gas aperture 92, and a vacuum aperture 94. The contact 88 is electrically coupled to the chuck 54*a* to provide an electrical path to the negative terminal of the power supply 70. A purge aperture is coupled to a pressurized source of purge gas (not shown), such as nitrogen ($N_2$), or any other suitably inert gas, such as air. The vacuum aperture 94 is coupled to a vacuum source (not shown) to hold the wafer 60 firmly against the bottom surface 62**.

The electrode assembly 58 is, during operation, held against the bottom surface 62 of the chuck **54*a*. The electrode assembly 58*a* can move up and down as suggested by the arrow 96 under the control of a transport mechanism 98. The electrode assembly 58*a* is moved away from the lower surface 62, for example, during the loading and unloading of the wafer 60 from the chuck 54*a*. Also, the electrode assembly 58*a*** is moved away from the surface during the aforementioned cleaning operation.

When in an operating position, the electrode assembly **58*a* engages the bottom surface 62 of the chuck 54*a* as well as the bottom (active) surface 68 of the wafer 60. The body 100 of the electrode assembly 58*a* can be made out of a conductive material, such as aluminum or out of a non-conductive material, such as teflon. The electrode assembly 58*a* is somewhat U-shaped having a longer leg 100, a shorter leg 102, and a connecting portion 104. The shorter leg 102 is provided with an electrode chamber 106 and an annular void 108. Disposed within the annular void 108 is an O-ring which surrounds the opening from the electrode chamber 106. Disposed within the electrode chamber 106 is an electrode or contact 110 which is biased by a spring 112 against the lower surface 68 of the wafer 60. A passageway 114 couples the aperture 90 to the electrode chamber 106, and a passageway 116 couples the purge aperture 92 to the annular void 108. A conductor 118 within passageway 114 connects the contact 88 to the biasing spring 112. When the electrode assembly 58*a* is in abutment with the lower surface 62 of chuck 54*a*, there is an electrically continuous path between the chuck 54*a*, the contact 88, the electrical conductor 118, the spring 112, the electrode 110, and the active surface of the wafer 68. The purge gas from aperture 92 flows around the O-ring 109 to provide a gas purge seal which supplements the O-ring seal 109, thereby preventing electrolytes, cleaning fluids and other fluids from contacting the electrode 110**.

Figure 7B:
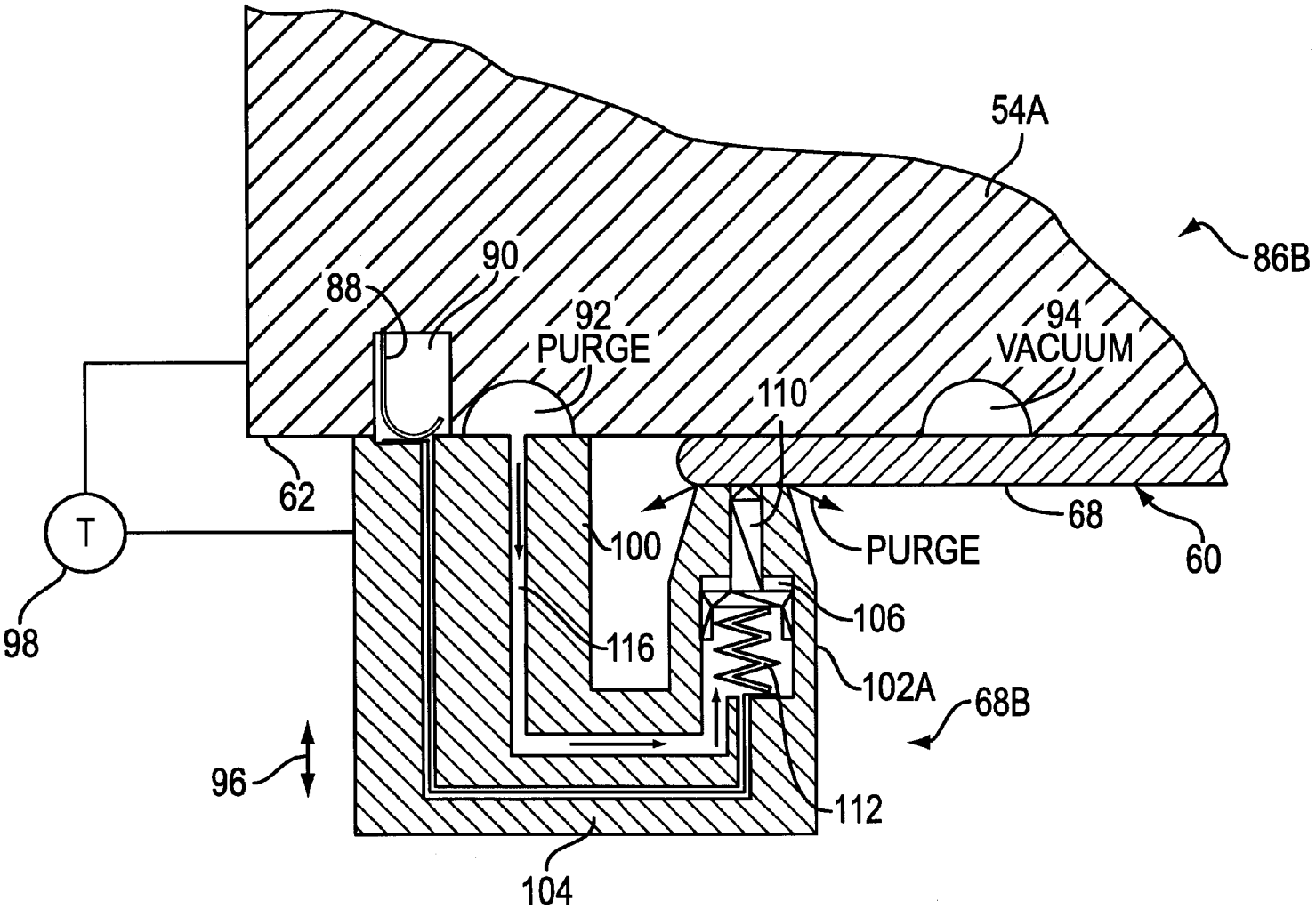

In FIG. 7B, a detail 86*b* discloses a structure for an electrode assembly 58*b*. Where the structure and operation of electrode assembly is similar to the structure and operation of electrode assembly 58*a* as described with reference to 7A, it will not be repeated here. In this embodiment, the chuck 54*a* of FIG. 7B is essentially the same as the chuck 54*a* of FIG. 7A. However, in this embodiment the second leg 102*a* is modified to remove the annular void 108 and the O-ring 109. The passageway 116 in FIG. 7B is coupled to the electrode chamber 106 to provide a purge gas around the electrode 110. The advantage of this design is that a smaller electrode assembly 58*b* can be provided which covers less of the active surface 68 of the wafer 60. Of course, the less area of the active surface 68 that is covered, the greater the usable area remains. However, this design does not seal as well against leakage in all instances as compared to the embodiment of FIG. 7A.

Figure 7C:
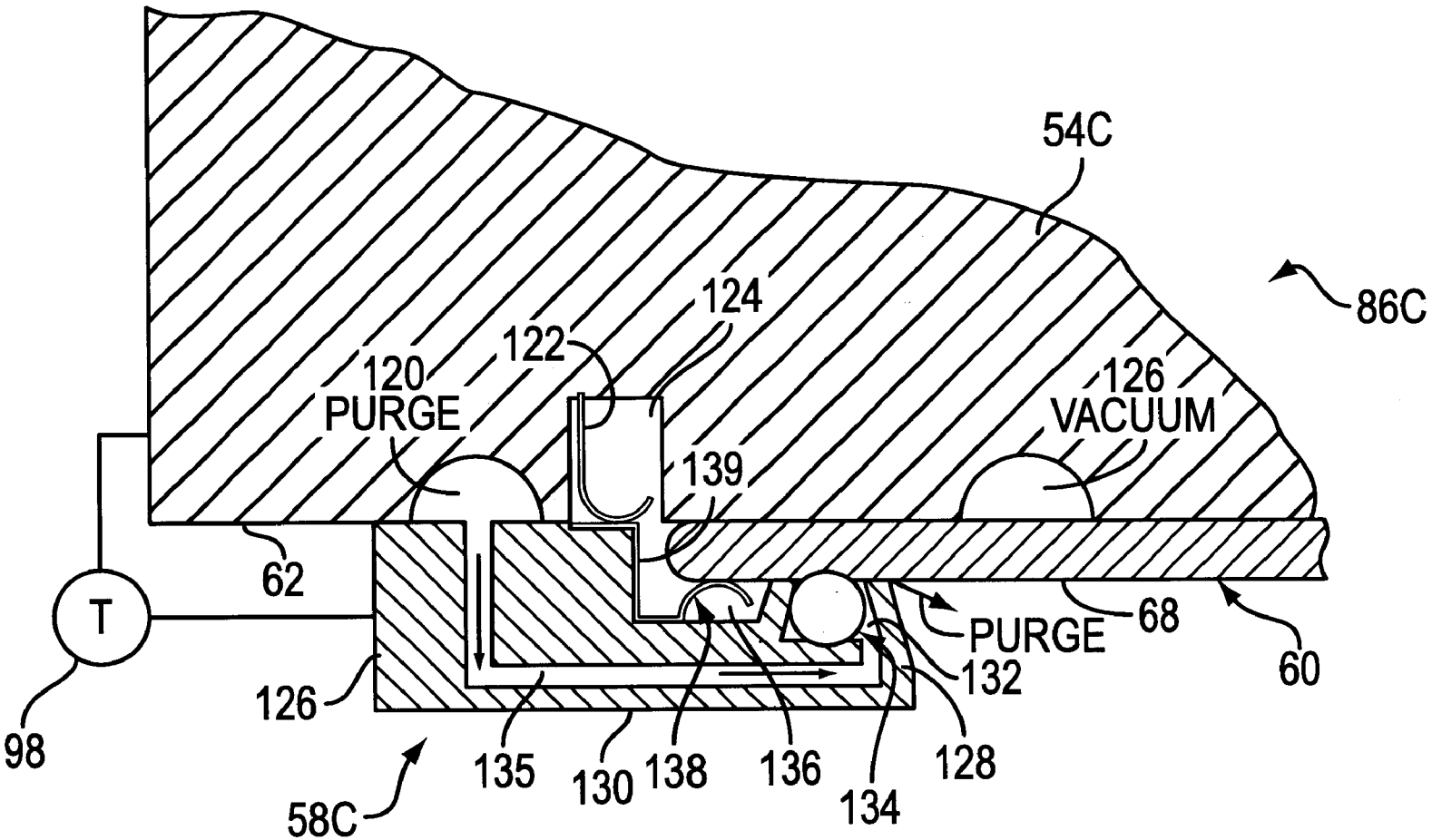
Figure 7D:
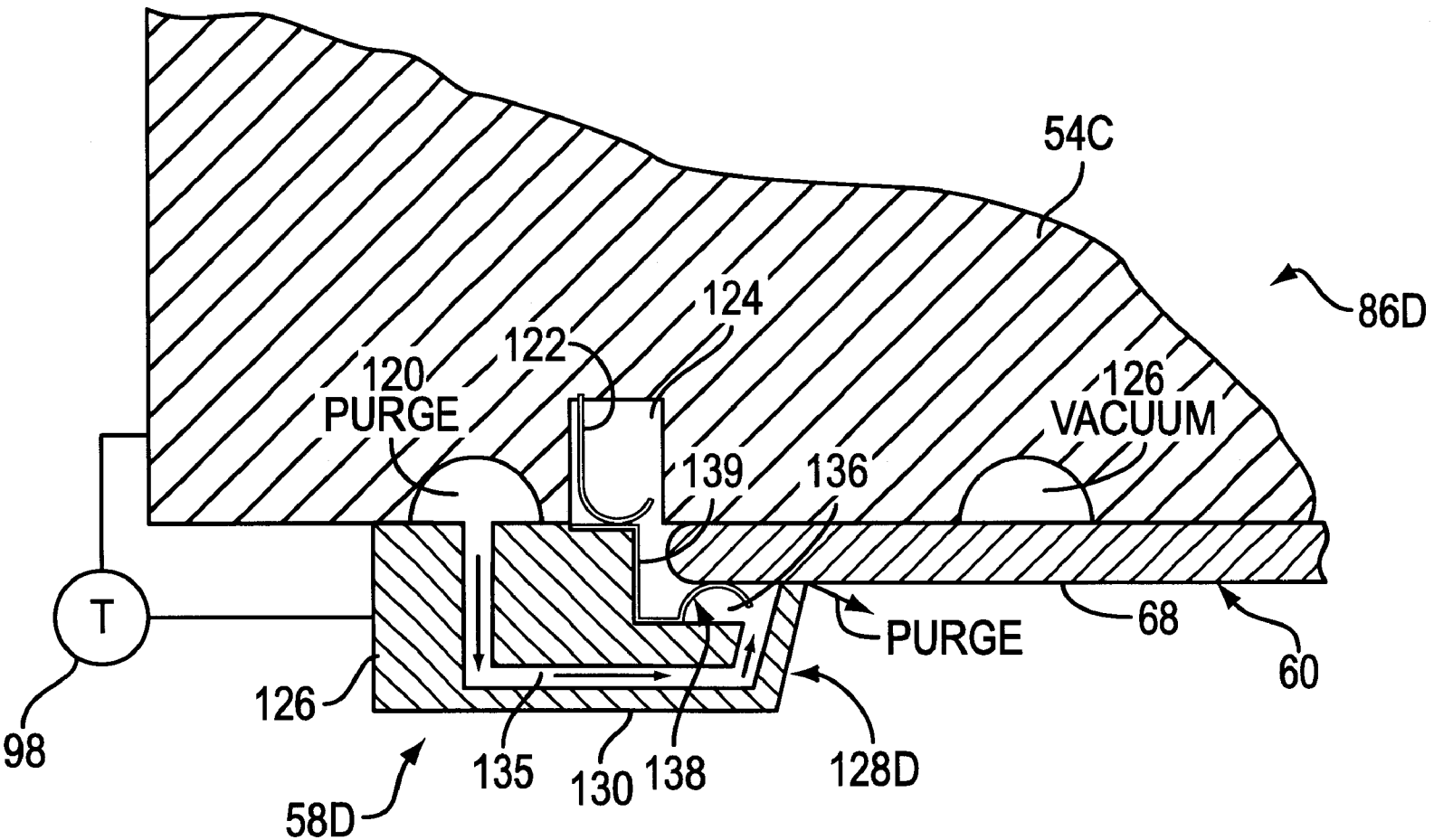

In FIG. 7C, another alternate embodiment for an electrode assembly 58*c* is illustrated. In this embodiment a chuck 54*c* is provided with a purge aperture 120, a contact 122 within an aperture 124, and a vacuum aperture 126. The electrode assembly 54*c* includes a longer leg 126, a shorter leg 128 and a connecting portion 130. In the embodiment of FIG. 7C, the electrode assembly 58*c* is annular in shape and is approximately the same diameter as the wafer 60. The leg 128 includes a large annular void 132 having a slightly smaller diameter than the diameter of the wafer 60. A large O-ring 134 is disposed within the annular void 132 and makes contact all the way around a perimeter portion of the wafer 60. The annular void 132 is coupled to the purge aperture 120 by a passage 135. A passage 136 couples the aperture 124 to the edge of the wafer 60. An electrode portion 138 electrically contacts the edge of the wafer 60, and is electrically coupled to the contact 122 by a conductor portion 139. The O-ring seal 134 makes a primary seal around a perimeter portion of the wafer, while the gas purge from annular void 132 provides a supplemental seal.

Figure 10:
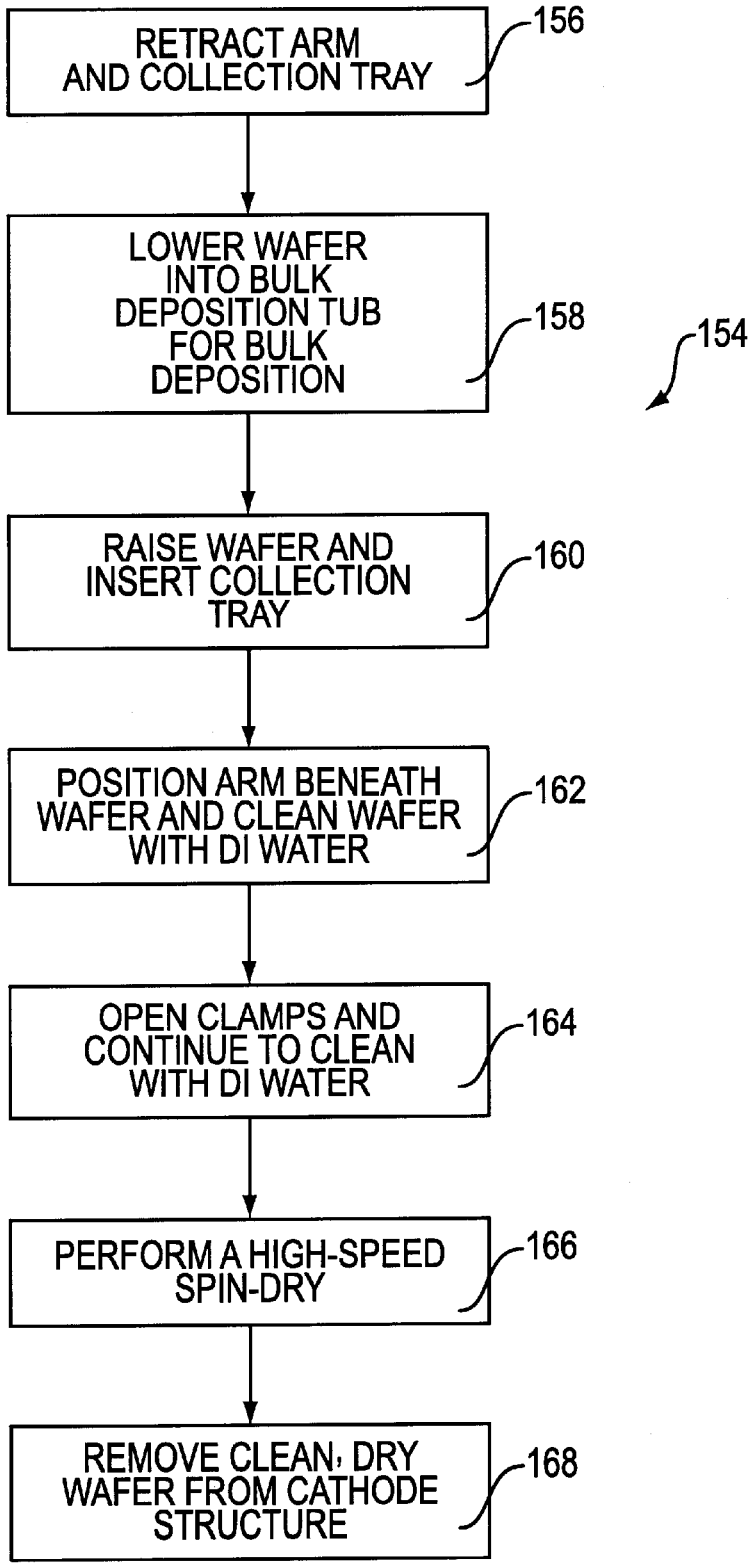
FIG. 10 is a flow diagram of one embodiment of an "additional processing" operation of FIG. 9.

The electrode assembly 58*d* of FIG. 10 is a modification of the electrode assembly 58*c* of FIG. 7C. In this embodiment, the O-ring seal and annular void for the O-ring seal has been removed, and the passage 135 for the purge gas is coupled to the passage 136. In this fashion, the gas purge seal provides the primary seal against fluids entering the electrode assembly 58*d*. This configuration reduces the amount of surface area covered by the electrode assembly, and simplifies the construction of the electrode assembly.

Figure 8A:
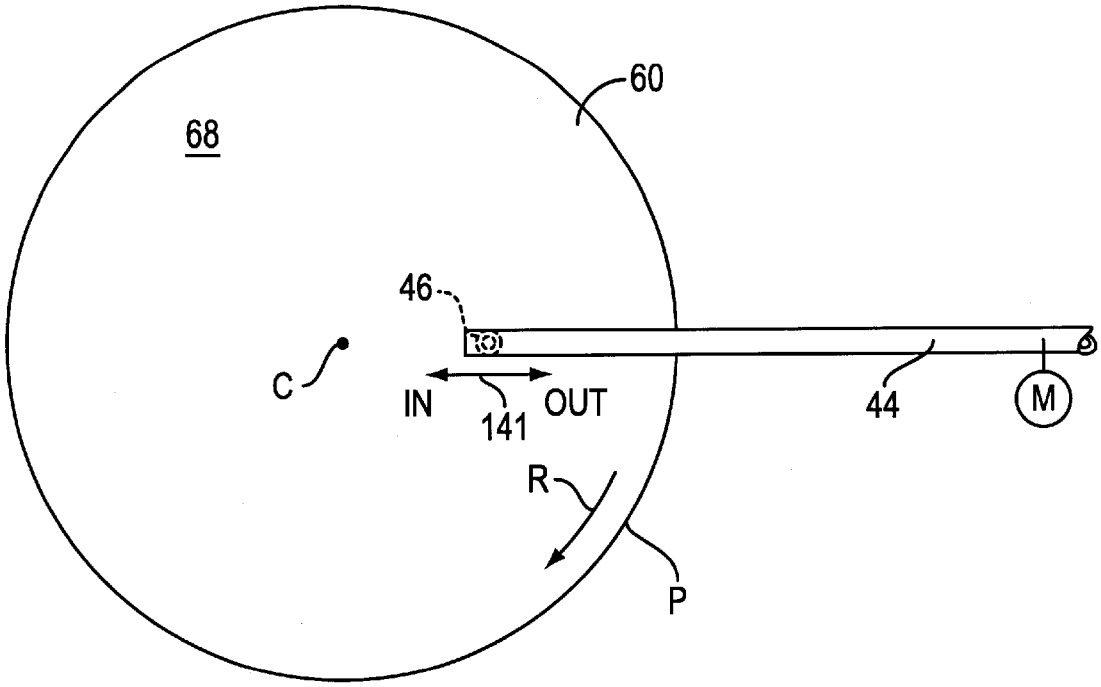
FIGS. 8A–8B illustrate two different methods for moving the anode structure of the present invention.

FIG. 8A illustrates a first method and apparatus for providing relative movement between the wafer 60 and the outlet 46. In this embodiment, the wafer 60 rotates as indicated by the arrow R, while the anode structure 44, shaped as a long, hollow arm, is caused to move radially in and out as indicated by arrow 141. Preferably, the outlet 46 is positioned near the perimeter P of the wafer 60, and slowly is moved radially inwardly towards the center C of the wafer 60 along the path 141 to form an ever-widening annulus of copper film on the active side 68. The movement of the arm is controlled by a servo M, such as a motor, solenoid, or other actuator, and is preferably under computer control.

Figure 8B:
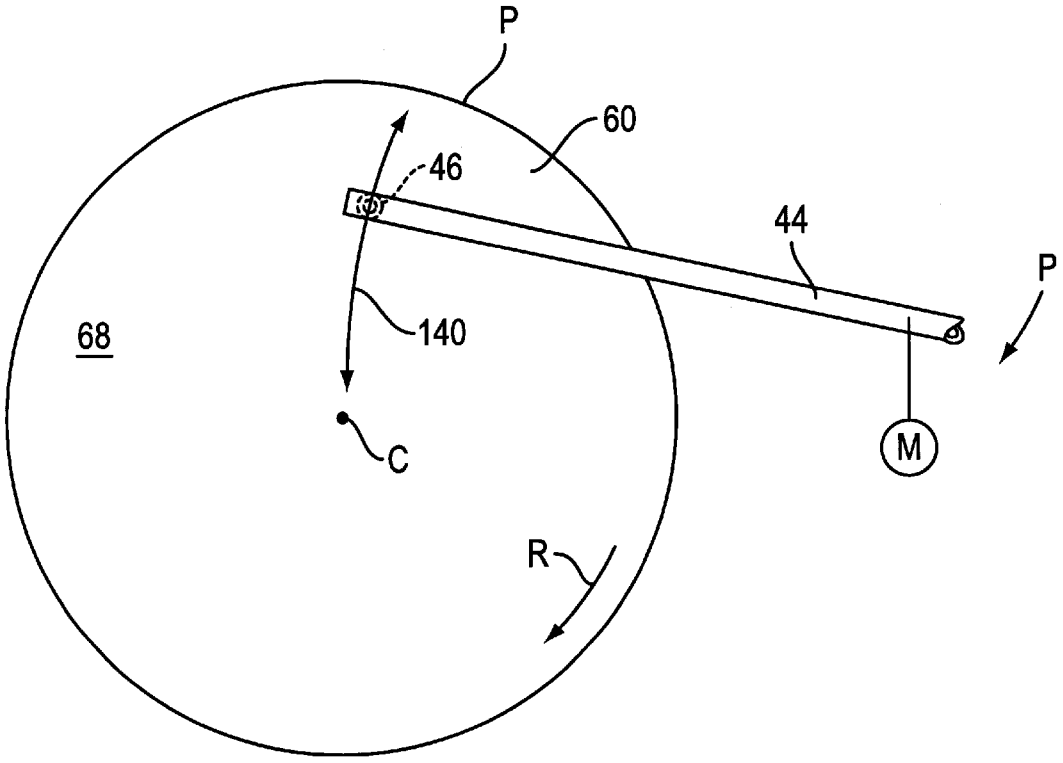

FIG. 8B illustrates a second method and apparatus for providing relative movement between the wafer 60 and the outlet 46. In this embodiment, the wafer 60 rotates as indicated by the arrow R, while the anode structure 44, which is again shaped as a long, hollow arm, is caused to move radially in and out as indicated by arrow 140. It should be noted that the term "radial" as used herein refers to movement towards or away from the center C, and need not be in a straight line. In this embodiment, the path is an arcuate path caused by a pivoting of the anode structure 44 around a pivot point P under the control of a servo M. This form of arm movement is common in disk drives. Again, preferably, the outlet 46 is positioned near the perimeter P of the wafer 60, and slowly is moved radially inwardly towards the center C of the wafer 60 along the path 140 to form an ever-widening annulus of copper film on the active side 68.

There are other methods and apparatus for providing relative movements between the wafer 60 and the outlet 46. For example, the wafer can be held stationary, and the anode structure 44 can be moved to provide the relative movement between the outlet 46 and the surface 68 of the wafer 60.

Figure 9:
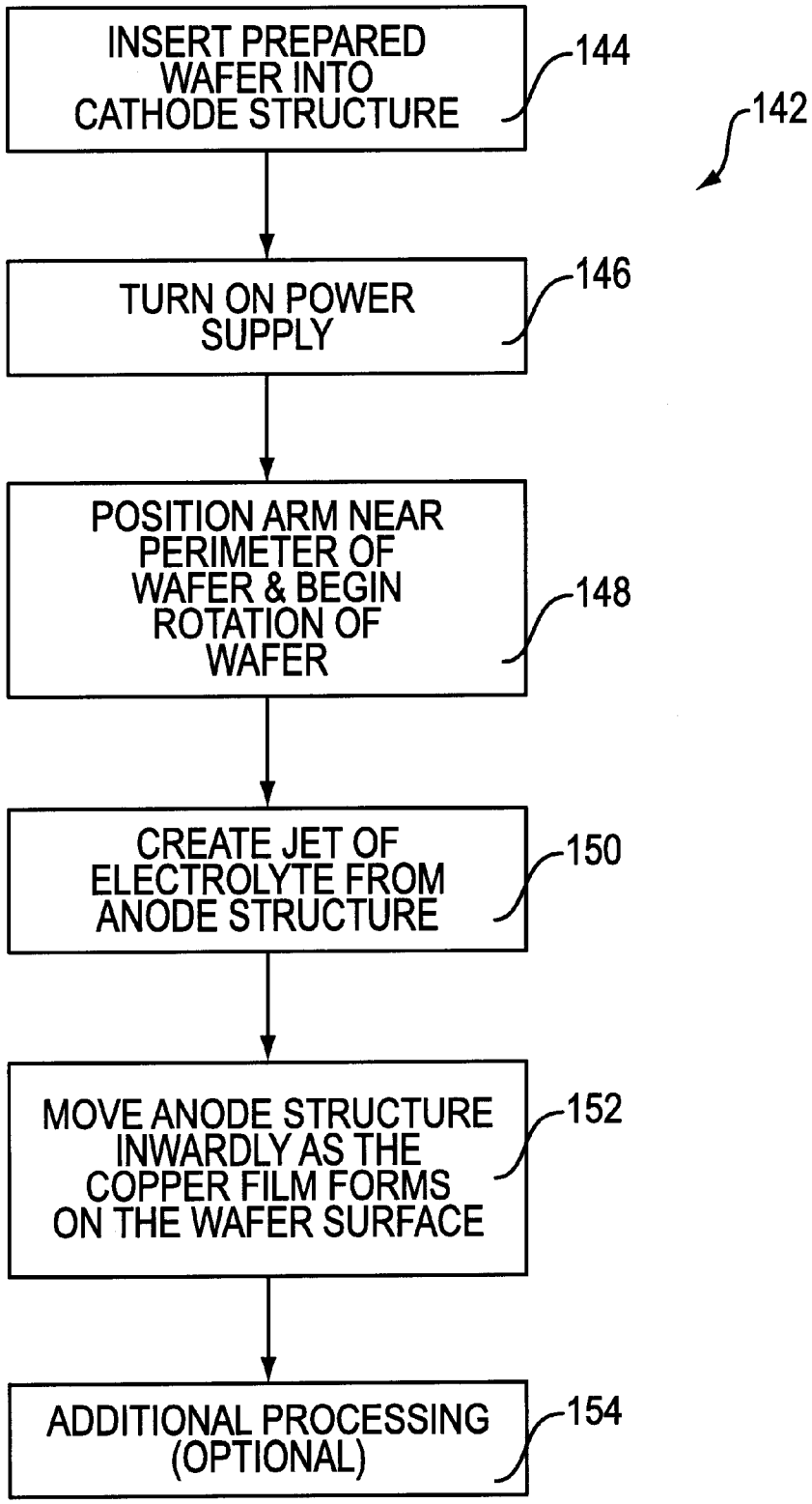
FIG. 9 is a flow diagram illustrating a process for electroplating in accordance with the present invention.

In FIG. 9, a process 142 to provide a metal film on a workpiece such as a semiconductor wafer includes the operation 144 of inserting a prepared wafer into a cathode structure. A wafer is typically prepared for copper deposition by providing a barrier layer, such as cobalt. The power supply is then turned on in an operation 146, and the anode structure (arm) is positioned near the perimeter of the wafer, and the wafer is rotated. A jet of electrolyte is expelled from the anode structure in an operation 150, and the anode structure is slowly moved towards the center of the wafer in an operation 152 to form a copper film on the wafer surface. The copper film starts at the perimeter, and grows as an ever-widening annulus towards the center of the wafer. By slowly, it is meant, for example, several minutes per inch of radial movement. This allows a relatively thick layer (film) of copper to build up, e.g. more than 500 Angstroms, and preferably 1000 Angstroms or more, such that the IR drop in the developing annulus is low between the electrode and the point of contact of the jet of electrolyte. An optional additional processing operation 154 completes the process 142.

In FIG. 10, an example of an additional processing operation 154 of FIG. 9 includes a bulk deposition process and a cleaning process. Alternatively, the additional processing operation can be only a bulk deposition process or only a cleaning process, or an entirely different process from either bulk deposition or cleaning.

In the example of FIG. 10, an operation 156 retracts the anode structure ("arm") 44 and collection tray 40 from beneath the cathode structure 36 and the wafer 60 held by the cathode structure. The wafer can then be lowered into the bulk deposition tub 42 in an operation 158 to perform a bulk deposition process. Next, the cathode structure 36 and, therefore, the wafer 60 is raised, and the collection tray 40 is reinserted beneath the wafer. The arm 44 is then inserted beneath the wafer, and deionized (DI) water is sprayed from outlet 46 to clean the active surface of the wafer 60. The DI water can be obtained from a source 50 under the control of valve 52. Next, the electrode assemblies ("clamps") 58 are opened to allow the DI water to clean the clamps and the surface of the wafer under the clamps in an operation 164. The wafer 60 is still being held to the cathode structure 36 by the vacuum arrangement described previously. Then, in an operation 166, the cathode structure 36 is rotated at high speed to spin-dry the wafer, the cathode structure, and the clamps. A clean, dry wafer with a high quality copper film is then removed from the apparatus in an operation 168.

While this invention has been described in terms of several preferred embodiments, it is contemplated that alternatives, modifications, permutations and equivalents thereof will become apparent to those skilled in the art upon a reading of the specification and study of the drawings. It is therefore intended that the following appended claims include all such alternatives, modifications, permutations and equivalents as fall within the true spirit and scope of the present invention.

What is claimed is:

1. An electroplating apparatus comprising:

a cathode structure configured to engage a perimeter portion of a workpiece;

an anode structure including an outlet disposed near an end of said anode structure;

a power source coupled between said cathode structure and said anode structure; and a pressurized electrolyte source coupled to said anode structure to provide an electrically continuous fluid jet of electrolyte from said outlet to be directed at a surface of said workpiece that is to be electroplated;

wherein said end of said anode structure including the outlet is radially moveable such that said outlet can be positioned at different positions relative to the surface of the workpiece.

2. An electroplating apparatus as recited in claim 1 wherein said workpiece is a semiconductor wafer, and further comprising a chuck for holding said semiconductor wafer.

3. An electroplating apparatus as recited in claim 2 wherein said chuck comprises a vacuum chuck adapted to engage a backside of said wafer and to support said wafer below said chuck.

4. An electroplating apparatus as recited in claim 2 wherein said cathode structure is supported by said chuck.

5. An electroplating apparatus as recited in claim 4 wherein said cathode structure forms a part of an electrode assembly which further includes a seal to inhibit electrolyte from contacting said cathode structure.

6. An electroplating apparatus as recited in claim 5 wherein said seal includes a source of pressurized purge gas coupled to said electrode assembly.

7. An electroplating apparatus as recited in claim 6 wherein said seal further includes an elastomeric seal.

8. An electroplating apparatus as recited in claim 1 wherein said outlet is provided with a jet nozzle.

9. An electroplating apparatus as recited in claim 8 wherein said jet nozzle is supported proximate to an end of an elongated arm.

10. An electroplating apparatus as recited in claim 9 wherein at least one of said arm and said nozzle is electrically conductive and is coupled to said power source.

11. An electroplating apparatus as recited in claim 4 wherein said chuck is adapted for rotation.

12. An electroplating apparatus as recited in claim 11 wherein said anode structure includes an elongated arm, where said outlet is provided near an end of said arm.

13. An electroplating apparatus as recited in claim 12 wherein said arm is adapted to move such that said outlet can be positioned at different radial positions with respect to said wafer.

14. An electroplating apparatus as recited in claim 1 further comprising a pressurized cleaning fluid source coupled adapted to provide a flow of cleaning fluid directed at said surface of said workpiece.

15. An electroplating apparatus as recited in claim 1 wherein said electrolyte comprises $CuSO_4$, said cleaning fluid comprises deionized water, and wherein said workpiece is rotated during the application of electrolyte and cleaning fluid.

16. An electroplating apparatus as recited in claim 1 wherein said flow of electrolyte is adjustable through a flow control mechanism.

17. An electroplating apparatus comprising:

a cathode structure electrically engaging a perimeter portion of a workpiece;

an anode structure including an outlet directing flow of electrolyte having positively charged ions towards a surface of said workpiece to be electroplated, wherein said anode structure comprises an arm, said outlet comprises a jet nozzle disposed near an end of said arm, and said end of said arm is moveable such that said jet nozzle can be positioned at different radial positions relative to the workpiece.

18. An electroplating apparatus as recited in claim 17, wherein said end of said arm of the anode structure is adapted to move radially towards a center of the workpiece along a straight line path.

19. An electroplating apparatus as recited in claim 18, wherein said end of said arm of the anode structure is adapted to move radially towards a center of the workpiece along an arcuate path resulting from pivoting said arm about a pivot point.

20. An electroplating apparatus as recited in claim 17 wherein the workpiece is adapted to rotate around an axis as said flow of electrolyte is directed towards said surface.

21. An electroplating apparatus as recited in claim 17 wherein said flow of electrolyte is adjustable through a flow control mechanism.

* * * * *